US006181886B1

(12) United States Patent
Hockey et al.

(10) Patent No.: US 6,181,886 B1
(45) Date of Patent: Jan. 30, 2001

(54) TONER REPLENISHMENT AND COLLECTION APPARATUS AND METHOD

(76) Inventors: David E. Hockey; Matthias H. Regelsberger, both of 901 Elmgrove; Christopher S. Garcia, 901 Elmgrove Rd.; Philip A. Stern, 901 Elmgrove Rd.; James A. Zimmer, 901 Elmgrove Rd., all of Rochester, NY (US) 14653-6029

( * ) Notice: Under 35 U.S.C. 154(b), the term of this patent shall be extended for 0 days.

(21) Appl. No.: 09/471,787

(22) Filed: Dec. 23, 1999

(51) Int. Cl.[7] ..... G03G 15/08; G03G 21/12
(52) U.S. Cl. ..... 399/35; 399/360
(58) Field of Search ..... 399/35, 34, 358, 399/359, 360

(56) References Cited

U.S. PATENT DOCUMENTS

| | | | |
|---|---|---|---|
| 4,934,314 | 6/1990 | Ideyama . | |
| 5,036,363 | 7/1991 | Iida et al. . | |
| 5,070,362 | 12/1991 | Noda . | |
| 5,095,331 | 3/1992 | Takano . | |
| 5,138,386 | 8/1992 | Okano et al. . | |
| 5,160,966 | 11/1992 | Shiina et al. . | |
| 5,182,600 | 1/1993 | Hasegawa et al. . | |
| 5,204,698 | 4/1993 | LeSueur et al. . | |
| 5,220,379 | 6/1993 | Fukuchi et al. . | |
| 5,227,847 | 7/1993 | Motohashi et al. . | |
| 5,374,977 | 12/1994 | Shiina et al. . | |
| 5,486,899 | 1/1996 | Iimori et al. . | |
| 5,754,916 | 5/1998 | Kitayama et al. . | |
| 5,905,932 | 5/1999 | Morse et al. . | |
| 5,909,604 * | 6/1999 | Arai | 399/35 |
| 5,918,085 * | 6/1999 | Rollins et al. | 399/27 |

* cited by examiner

*Primary Examiner*—Richard Moses
(74) *Attorney, Agent, or Firm*—James D. Leimbach

(57) ABSTRACT

An apparatus and method for replenishing toner and collecting used toner in an electrostatographic machine. The apparatus includes a replenishment hopper having a supply of fresh toner. A development device feeds toner onto a recording member having an electrostatic image to be developed. A feeding device feeds fresh toner to the development device from a replenishment bottle. A replenishment motor drives the feeding device to feed fresh toner to the development device. A collection container or bottle collects used toner removed from a recording member. A controller tracks a first accumulated motor operating on-time and is programmed to compare the operating on-time with a first pre-programmed value for determining when the collection container is to be emptied or to be replaced or that the machine is to be cycled down. The controller also tracks a second accumulated motor operating on-time for determining when the replenishment bottle is to be replaced.

17 Claims, 4 Drawing Sheets

TONER REPLENISHMENT AND COLLECTION APPARATUS AND METHOD

FIELD OF THE INVENTION

The present invention relates to electrostatography and more particularly to control of replenishment and collection of used toner in an electrostatographic recording apparatus.

DESCRIPTION RELATIVE TO THE PRIOR ART

In U.S. Pat. No. 5,227,847, there is disclosed image-forming apparatus that develops a latent image electrostatically formed on image carrier by a developing device, transfers the developed image to a recording medium, and then removes the toner remaining on the image carrier by a cleaning device. The untransferred toner is collected in a collecting section of the cleaning device. The apparatus determines whether or not the toner collected in the collecting section has reached a predetermined amount by determining whether or not fresh toner has been supplemented to the developing device a predetermined number of times. When the apparatus repeats an image-forming cycle with a single supplement of toner, the amount of toner to be collected in the collecting section is substantially fixed by the type of equipment and, therefore, the toner collected in the collecting section reaches a predetermined amount when the toner is supplemented the particular number of times. Specifically according to the prior art, the number of times that the toner is supplemented to the developing device is counted on the basis of the output of a supplement detector which determines whether or not the developer has been supplemented. The supplement detector determines that toner has been supplied only when a predetermined number of copies have been made after a toner low/empty signal is indicated or the toner concentration is detected to increase after the toner low/empty signal is indicated. The problem with the above is that it requires the relation of signals of conditions of toner concentration with accumulation of toner in the collecting section which are not necessarily related. Additionally, it provides a complex algorithm for determining if the collecting section is full based on a counting of copying cycles.

It is therefore an object of the invention to provide a method and apparatus for replenishing and collecting used toner that represents an improvement over the prior art.

SUMMARY OF THE INVENTION

In accordance with one aspect of the present invention there is provided an electrostatographic machine for replenishing toner and collecting used toner in which the apparatus comprises a replenishment hopper having a supply of fresh toner, a development device for depositing toner onto a recording member having an electrostatic image to be developed, a feeding device for feeding fresh toner to the development device, a driver for driving the feeding device to feed fresh toner to the development device, a collection container for collecting used toner removed from a recording member, and a controller for tracking a first accumulated driver operating on-time and being programmed to compare the first accumulated operating on-time with a first pre-programmed value for determining when the container is to be emptied or to be replaced and providing a signal to indicate that the container is full or to be emptied or to be replaced. The signal to indicate that the container is full or to be emptied or to be replaced may enable a display to indicate to the operator such a condition exists or may set a flag or other signal in memory that can be accessed by a service person either at the machine or remotely. The signal may be used to generate a phone call via a modem to a service person.

In accordance with a second aspect of the invention there is provided an electrostatographic machine for replenishing toner and collecting used toner that comprises providing a replenishment hopper having a supply of fresh toner, operating a development device for depositing toner onto a recording member having an electrostatic image to be developed, driving a feeding device and feeding fresh toner to the development device, collecting used toner in a collection container, and tracking a first accumulated driver operating on-time and comparing the first accumulated operating on-time with a first pre-programmed value for determining when the container is full or to be emptied or to be replaced and providing a signal to indicate that the container is full or to be emptied or to be replaced. Alternatively, there may be provided a signal to cycle down the machine.

BRIEF DESCRIPTION OF THE DRAWINGS

The above and other objects, features and advantages of the present invention will become more apparent from the following detailed description taken in conjunction with the accompanying drawings in which.

DETAILED DESCRIPTION OF THE INVENTION

Because apparatus of the general type described herein are well known, the present description will be directed in particular to elements forming part of, or cooperating more directly with, the present invention. While the invention will be described with reference to an electrophotographic system, the invention can also be used in an electrographic system too and thus electrostatography in general.

Figure 1:
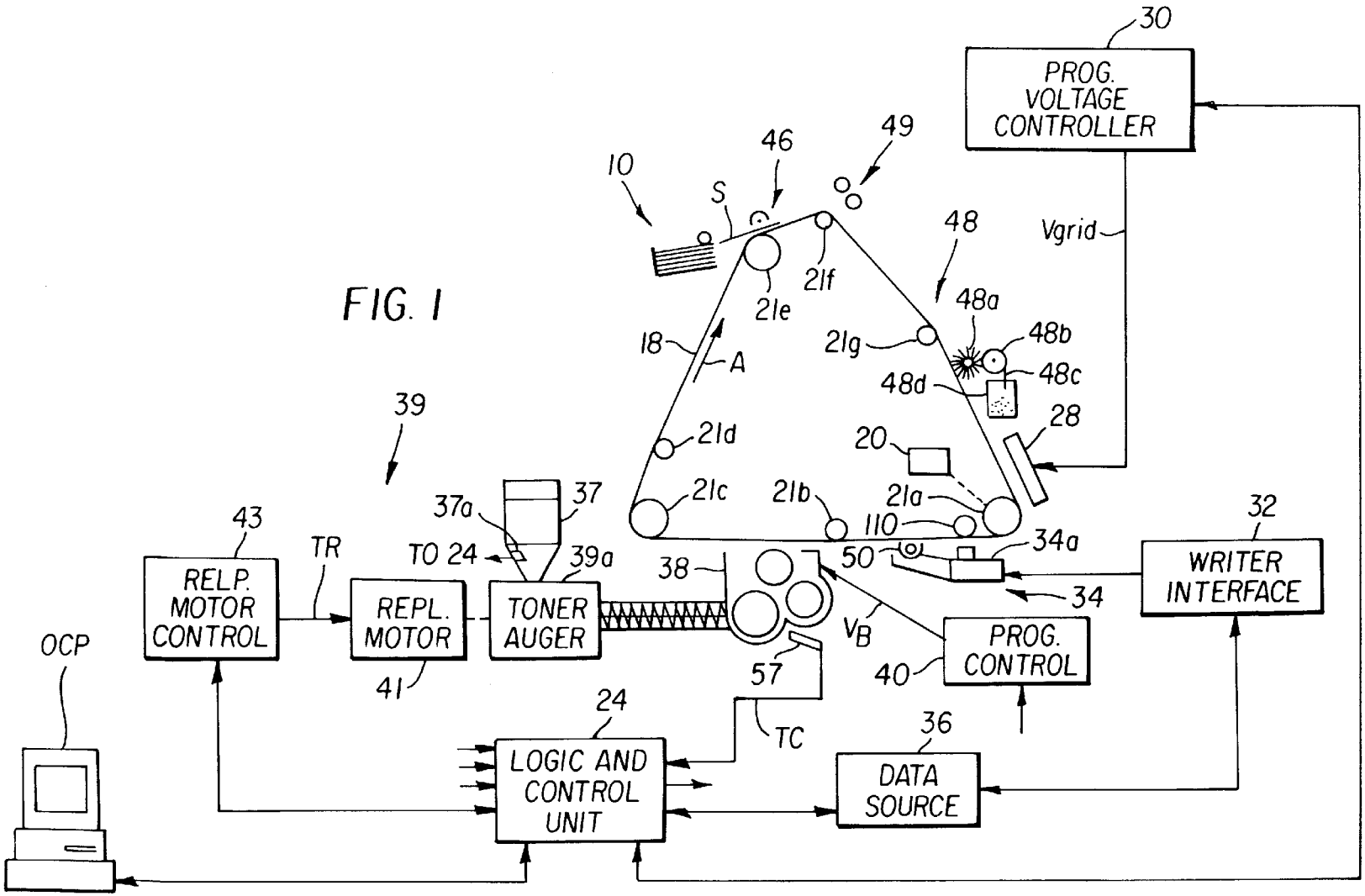
FIG. 1 is an illustration in schematic form of an image forming apparatus in accordance with the invention.

With reference to the electrostatographic copier and/or printer machine 10 shown in FIG. 1, a moving recording member such as a photoconductive belt 18 is entrained about a plurality of rollers or other supports 21 *a–g*, one or more of which are driven by a motor 20 so as to advance the belt in a direction indicated by an arrow A past a series of workstations of the copier/printer machine. A photoconductive drum may be used instead of the belt. The logic and control unit (LCU) 24, which has a digital computer has a stored program for sequentially actuating the workstations in response to signals from various sensors and encoders as is well known.

The LCU includes a microcomputer and provides overall control of the apparatus and its various subsystems as is well known. Programming of a commercially available microprocessor is a conventional skill well understood in the art.

Briefly, a primary charging station 28 sensitizes belt 18 by applying a uniform electrostatic charge of a predetermined primary voltage to the surface of the belt. The output of the charging station is regulated by a programmable voltage controller 30, which is in turn controlled by LCU 24 to adjust primary voltage for example through control of electrical potential to a grid that controls movement of corona charge from high-voltage charging wires to the surface of the recording member as is well known. Other forms of chargers, including brush or roller chargers, may also be used.

At an exposure station 34, projected light from a writer 34*a* selectively dissipates the electrostatic charge on the photoconductive belt to form a latent electrostatic image of the document to be copied or printed. The writer preferably has an array of light emitting diodes (LEDs) or other light source such as a laser or other spatial light modulator for exposing the photoconductive belt picture element (pixel) by picture element with a regulated intensity and exposure. Alternatively, the exposure may be by optical projection of an image of the document onto the photoconductive belt.

Where an LED or other electro-optical exposure source or writer is used, image data for recording is provided by a data source 36 for generating electrical image signals. The data source 36 may be a computer document scanner, a memory, a data network, etc. Signals from the data source and/or LCU also provide control signals to a writer interface 32 for identifying exposure correction parameters. Travel of belt 18 brings the areas bearing latent charge images into a development station 38. The development station has a magnetic brush in juxtaposition to, but spaced from, the travel path of the belt. Magnetic brush development stations are well known but other types of development stations or devices may be used as is also well known and plural development stations may be provided for developing images in plural colors or with toners of different physical characteristics.

LCU 24 selectively activates the development station in relation to the passage of the image areas containing latent images to selectively bring the magnetic brush into engagement with or a small spacing from the belt. The charged toner particles of the magnetic brush are selectively attracted to the latent image pattern to develop the image pattern.

As is well known in the art, conductor portions of the development station, such as conductive applicator cylinders, act as electrodes. The electrodes are connected to a variable supply of DC potential $V_B$ regulated by a programmable controller 40. Details regarding the development station are provided as an example, but are not essential to the invention. It is preferred that the development station contain a two component developer mix which comprises a mixture of toner and carrier particles. Typically the carrier preferably comprises high coercivity (hard magnetic) ferrite particles. As an example, the carrier particles have a volume-weighted diameter of approximately thirty micrometers. The dry toner particles are substantially smaller and of the order of 6–15 micrometers in volume-weighted diameter. The development station may include an applicator having a rotatable, magnetic core within a shell which also may be rotatably driven by a respective motor or other suitable driving means. Rotation of the core and shell moves the developer through a development zone in the presence of an electrical field. In the course of development, the toner selectively electrostatically adheres to the image member to develop the electrostatic images and the carrier remains with the development station. As toner is depleted from the development station due to the development of the electrostatic image, additional toner is periodically introduced into the development station to be mixed with the carrier particles to maintain a uniform amount of development mixture. This development mixture is controlled in accordance with various development control processes which are well known in the art.

Addition of toner to the development station may be made from the toner replenisher device 39 that includes a source of toner in a hopper or container or bottle 37. A toner auger or other known conveyance or feeding device having predictability may be enabled for transporting or feeding the fresh toner to the development station 38. The replenishment motor 41 is provided as a driver for driving the auger. A replenishment motor control circuit 43 controls the speed of the auger as well as the times the motor is operating and thereby controls the feed rate and the times when toner replenishment is being provided. Typically, the motor controller 43 operates at various adjustable duty cycles that are controlled by a toner replenishment signal TR that is input to the replenishment motor controller 43. Typically, the signal TR is generated in response to a detection by a toner monitor of a toner concentration that is less than that of a fixed set point value. For example, a toner monitor probe 57*a* is a transducer that is located or mounted near or within the development station and provides a signal TC related to toner concentration. The signal is input to the toner monitor, which may be part of the LCU, and which in turn causes a signal to be generated in accordance with a predetermined relationship between TC and a voltage monitor signal. The voltage monitor signal is then compared with say a fixed set point voltage and used to adjust the rate of toner replenishment through adjustment of the toner replenishment signal TR. Although the development mixture is preferably a so-called two-component developer, the invention may also be used for single component systems and for liquid as well as the dry development system described.

A transfer station 46, as is also well known, is provided for moving a receiver sheet S into the engagement with the photoconductive belt in register with the image for transferring the image to the receiver sheet. Alternatively, an intermediate member may have the image transferred to it and the image may then be transferred to the receiver sheet. A cleaning station 48 is also provided subsequent to the transfer station for removing toner from the belt 18 to allow reuse of the belt surface for forming additional images. After transfer of the unfixed toner images to a receiver sheet, the sheet is detacked from the belt and transported to a fuser station 49 where the image is fixed. Alternatively, the image may be fixed at the time of transfer.

Cleaning of the belt for reuse may be provided by various known types of cleaning devices such as, for example, a blade or brush (including magnetic brush). The details of the particular cleaner are not essential to this invention. Where a brush is used, a detone roller 48*b* may be provided for removing toner from the brush as shown for example in U.S. Pat. No. 5,905,932. A scraper blade 48*c* is then used to remove toner from the detone roller. Toner removed by the blade is allowed to fall into or is otherwise transported to a collection chamber or bottle 48*d*. Typically, such chambers are provided with sensors for determining when the chamber is full, however, in the preferred embodiment of the invention, sensing of the level of toner in the collection chamber or bottle is not required. However, such sensor may be used, so that the apparatus of the invention provides a supplementary function to a sensor.

The control of providing signals relative to the level of toner in the toner replenishment bottle 37 and the toner collection bottle 48*d* is provided by the LCU. The LCU is programmed in accordance with the programs to be described by the flow charts below so as to provide signals which can be displayed on the operator control panel (OCP) of the copier/printer or transmitted to some other remote location for display to an operator, user or service person.

A toner level sensor 37 is preferably located inside of the replenisher hopper. The sensor senses when the total level drops below the level of the sensor. Several types of sensors are well known and may be used.

Figure 2A:
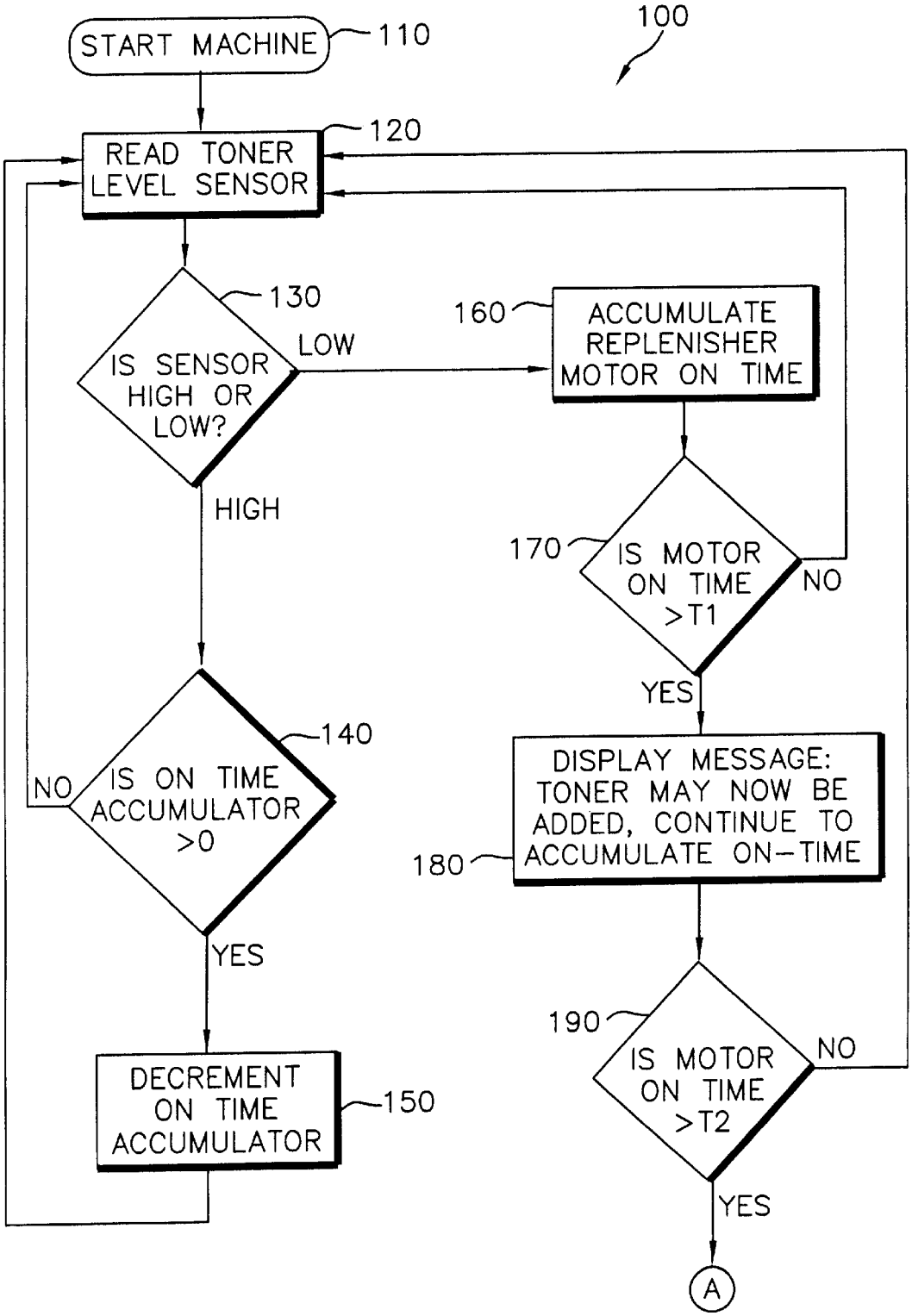
FIG. 2A and 2B is a flow chart for operation of a controller in the apparatus of FIG. 1 relative to control of low toner in a toner replenishment bottle.
Figure 2B:
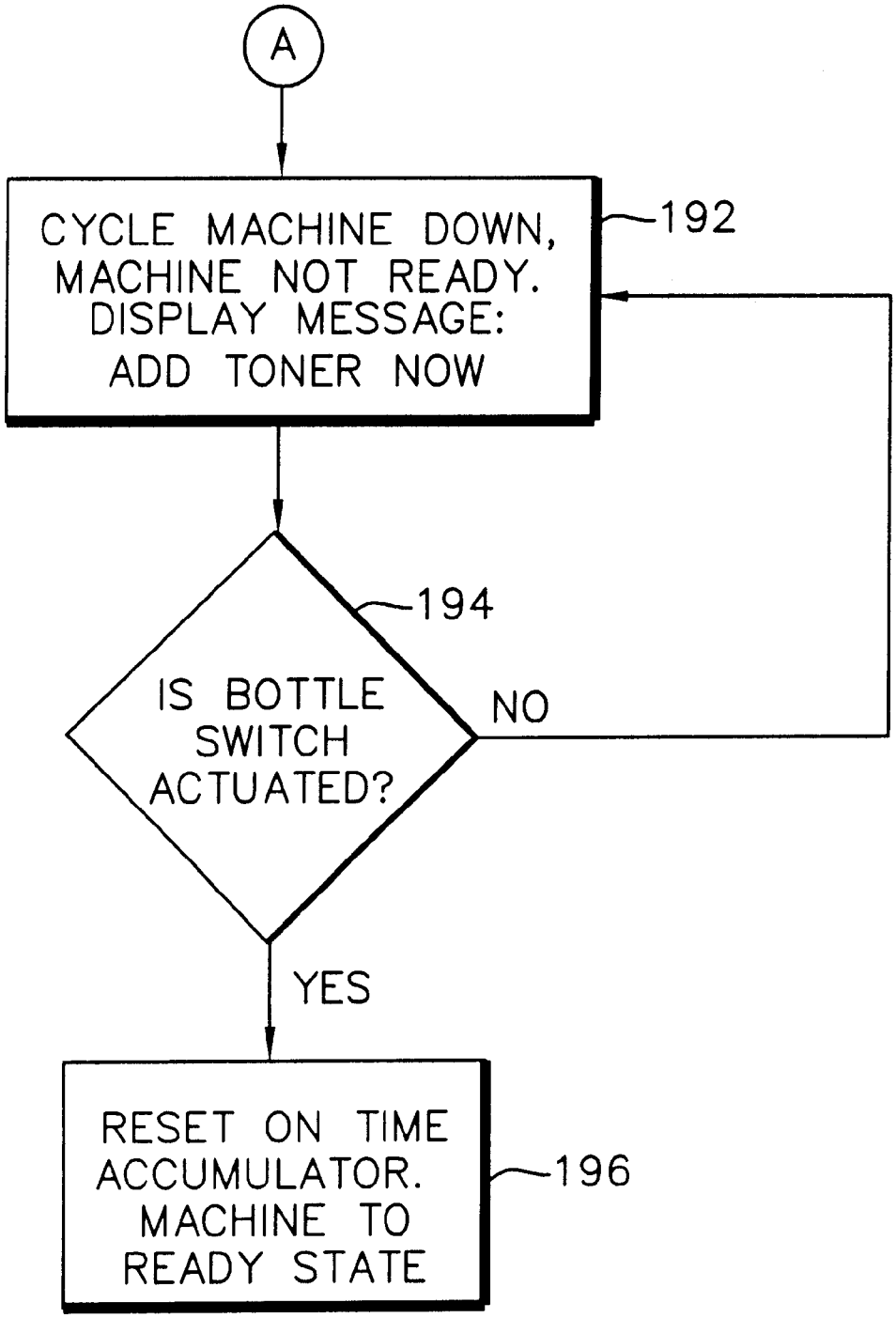

With reference now to FIG. 2 and the flow chart 100, in step 110 the copier/printer machine or apparatus is started. The toner level sensor signal is sensed by the LCU in step 120. A decision is made as to whether or not the sensor level is high or low, step 130. If the level in the hopper is sensed to be a higher level of toner, a determination is made in step 140 as to whether or not an accumulated replenishment motor on-time value stored in memory in the LCU is greater than zero. If the answer is yes, the on-time accumulated value is decremented to zero, step 150 and the process returns back to step 120. If the answer to the decision in step 140 is no, the flow chart also returns to step 120, thus, ensuring that where the level of toner in the hopper is not below the toner sensor, the accumulated value of motor on-time in memory is set or reset to zero.

As toner is delivered to the development station by motor operation of auger 39*a*, eventually the level of toner in the hopper falls below that of the sensor. Upon the occurrence of this event, a low toner signal is sent by the sensor and received by the LCU. The LCU then begins to accumulate the amount of on-time of the replenishment motor 41 subsequent to detection of a low toner signal, step 160. The replenishment motor is preferably controlled using pulse-width modulation and the duration of each pulse is accumulated in the memory of the LCU. During the course of accumulating motor on-time, a determination is continually made as to whether or not the motor on-time is greater than a predetermined value T1 stored in the LCU's memory that has been determined by the service person or the manufacturer to be a time at which notice should be provided to the operator or user via the OCP that "toner may now be added, continue to accumulate on-time," step 180. If the accumulated on-time has not as yet reached T1, the process returns to step 120. If the accumulated motor on-time is greater than T1, the message is displayed on the OCP thereby providing some notice that the toner supply is low and to be replaced at a convenient time. As the message continues to be displayed while the machine is in a standby and working mode (copy producing), the LCU continues to accumulate toner replenishment motor on-time as replenishment of toner occurs. In step 190 determination is repeatedly made as to whether or not replenishment motor on-time is greater than a predetermined value T2 (T2>T1) stored in the LCU's memory. If not, the process returns to step 120 for repeating. If the answer to the determination in step 120 is yes, the LCU provides a command to cycle down the machine and provides a message on the OCP to "Add Toner Now," step 192. In response to the cycle down command, the apparatus completes the processing of any images formed so that copies of such images are output but no new images are created. The apparatus then cycles down into a standby mode. The LCU awaits any indication that the bottle change switch has been actuated. This switch provides a signal when the toner replenishment bottle has been removed and then a signal when a new toner replenishment bottle (presumably full with fresh toner) has been inserted. The signals are detected by the LCU in step 194. If a new bottle is detected, the LCU resets the accumulated value of replenishment motor on-time in memory to zero and sets the machine to the ready state. If the machine is allowed to cycle out when the accumulated replenishment motor on-time is between T1 and T2, the display on the OCP will be provided with a message to add toner now and not allow the machine to be restarted until the toner replenishment bottle has been changed. Once a new toner replenishment bottle has been inserted, the resetting of the on-time accumulator memory is made because the toner level is expected to be well above the toner level sensor and the whole cycle will start over again when the level reaches that of the sensor.

It is preferred that determination that the toner level is below the sensor be filtered to account for nonuniformities in the level. The level of toner in the replenishment bottle can be redistributed through activation of the replenisher basket. When the toner is determined to be just below the sensor 37*a*, there is a fixed volume of toner remaining in the replenisher hopper. Through testing, it is possible to determine how much replenishment motor on-time it would take to fully deplete the replenisher hopper.

The threshold points indicated as T1 and T2 are determined experimentally. They are related to the geometry of the hopper, the agitation method and the material flowing through the hopper. In some machines, the replenishment bottle may remain in the machine attached to the hopper. In other machines, the replenishment bottle may be removed after filling of the hopper with the fresh toner.

Using the toner level sensor with the appropriate algorithm as described allows the machine to run as long as possible once the toner level has reached that of the level sensor. This is an improvement over previous concepts which, once the toner level reaches the sensor, the machine is allowed to run for a fixed number of prints only. The number of prints would be determined based upon the known amount of toner that would remain in the sump and a predicted level of takeout (biased for high takeout). With the algorithm described herein, the number of prints the customer can make after the toner reaches the level of the sensor is dependent upon the amount of toner taken out of the replenishment hopper which is a function of the amount of toner needed to make the images being printed. This allows a long runtime if the image is a very low takeout while a shorter runtime is permitted for a high takeout document.

The concept of accumulating the replenishment motor on-time can also be applied to the cleaning subsystem. By continuously accumulating the replenishment motor on-time, the amount of toner delivered to the toning station is known based upon the replenishment delivery rate. Toner delivered to the station can exit the station in one of two modes, first through dusting (which is a relatively small amount) and secondly through development of the latent image on the film loop. The majority of the toner on the photoconductor is transferred to paper for delivery to the customer. Any toner remaining on the photoconductor after transfer is cleaned from the photoconductor via the cleaning subsystem and transported to the collection bottle. Through testing, a relationship can be determined between the amount of toner collected by the cleaning subsystem, and the amount of toner delivered from the replenisher. For a given amount of replenishment motor on-time, it can be determined how much longer the replenishment motor can be on until the cleaning subsystem's collection bottle is full. Incremental warnings can be logged to the machine, service person and/or the customer to identify the state of the collection bottle. Eventually, when the bottle is determined to be full, the machine can display a message to notify the service person, or the machine can notify the service person directly, if the machine is so equipped. Once the bottle has been emptied, a software reset is performed and the replenishment on-time counter begins from zero.

Determination of the level in the toner collection bottle would also benefit from the addition of pulse-width modulation on the replenishment motor as mentioned above. Using pulse-width modulation, the on-time would be more predictive of the delivery rate of toner from the replenisher.

Figure 3:
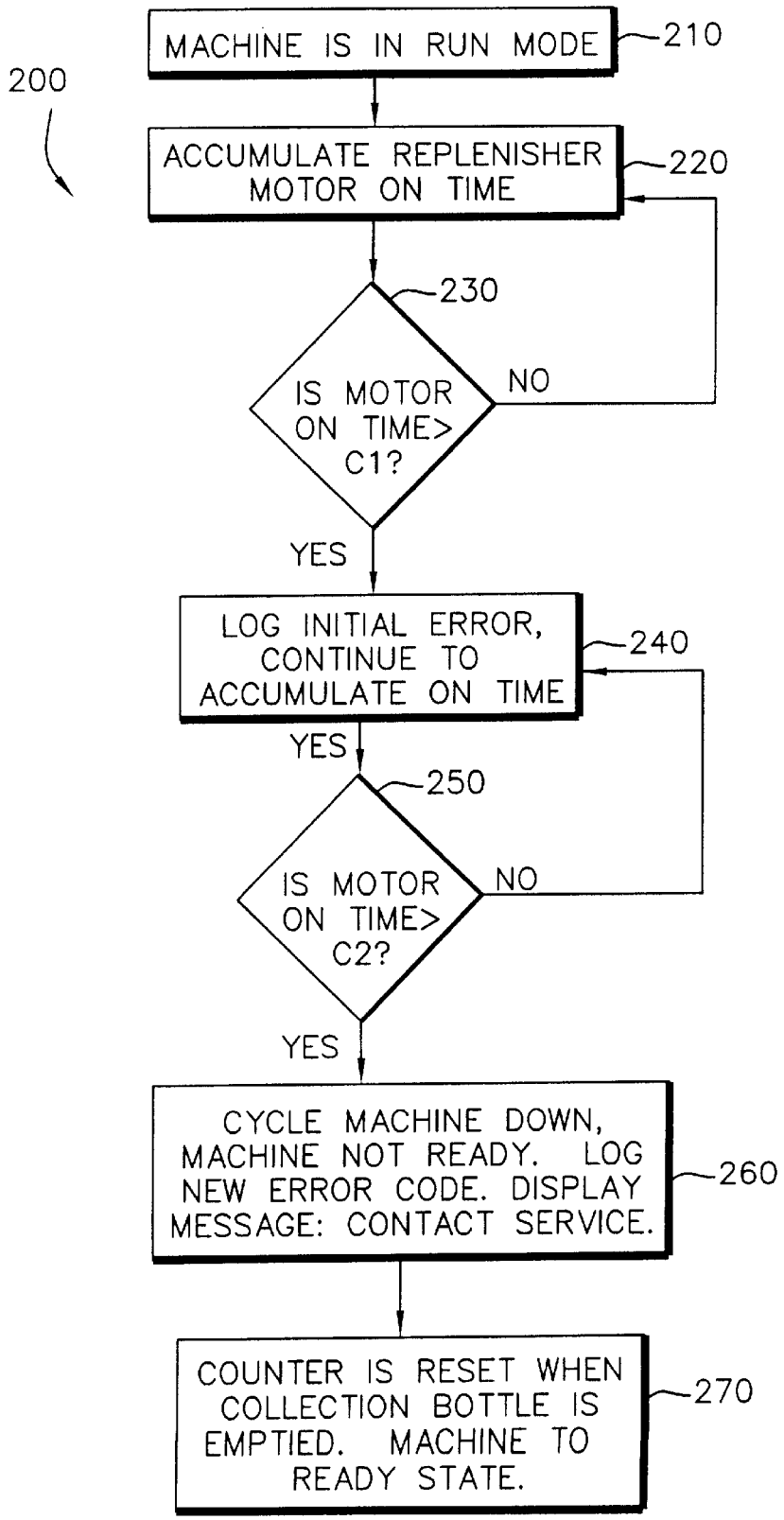
FIG. 3 is a flow chart for operation of a controller in the apparatus of FIG. 1 relative to control of high toner levels in a toner collection bottle.

With reference now to the flow chart 200 of FIG. 3, in step 210 the machine is determined to be in a run mode; i.e. a mode for producing images. In step 220 the LCU accumulates replenishment motor on-time. In step 230, a decision is made by the LCU as to whether or not the value of replenishment motor on-time stored in the LCU's memory is greater than C1, which is a predetermined value also stored in the LCU's memory. If no, the process returns to step 220 and replenishment motor on-time is continued to be accumulated in the memory. If the answer is yes a log of an initial error is made and stored as a flag in the memory and the LCU continues to accumulate replenishment motor on-time, step 240. In step 250 a determination is made as to whether or not accumulated replenishment motor on-time is greater than a value C2 a predetermined value stored in the LCU's memory (C2>C1). If the answer in step 250 is no the process returns to step 240. If the answer in step 250 is yes, the process steps to step 260. In step 260, the machine is instructed by signals from the LCU to cycle down and display a message on the OCP that the machine is not ready. A new error code is logged and stored as a flag in the LCU's memory. A message is also displayed to contact service. The accumulation counter in the LCU's memory is reset when the toner collection bottle 48*d* is emptied. This can be detected by removal of the collection bottle and replacement of the collection bottle at the cleaning station or where the bottle is located, there being a switch which senses such removal and replacement and provides appropriate signals to the LCU. As noted above, the values of C1 and C2 are determined experimentally. Upon the accumulated replenishment motor on-time being greater than C1, a message may be provided on the OCP that the toner collection bottle should be emptied at a convenient time. The value of C2 is chosen based on experiments which indicate that this value can be used to assume that the toner collection bottle is full and needs to be emptied. When the LCU detects that the collection bottle has been emptied and replaced, the memory which stores accumulated replenishment motor on-time relative to accumulation of toner in the collection bottle is reset and the machine is restored to the ready state step 270.

It will be appreciated that because replacement of the toner replenishment bottle can occur at times different from that for replacement of the toner collection bottle that different values of accumulated motor on-time are tracked simultaneously by the LCU.

By using the replenishment motor on-time, it is not necessary to add level sensor hardware in the collection bottle. By eliminating the sensor, machine cost can be reduced. In addition, the on-time method allows for multiple messages to be logged as the bottle fills. With some devices only one signal is available per device (full or not full), requiring multiple sensors to determine multiple levels. By using the on-time method, this redundancy can be avoided. Additionally, due to the nature of the collection bottle, it has been shown that level sensors are inherently unreliable. The contamination that is present in the bottle, in conjunction with the airflow caused by the vacuum system, often produces erroneous signals. The replenishment motor on-time method yields a reliable solution with no additional hardware cost. The determination of the level in the toner collection bottle is also benefited from the use of a replenishment motor which employs pulse-width modulation. Using pulse-width modulation, the on-time is more predictive of the delivery rate of the toner from the replenisher.

The invention has been described in detail with particular reference to certain preferred embodiments thereof, but it will be understood that variations and modifications can be effected within the spirit and scope of the invention.

What is claimed is:

1. In an electrostatographic machine, an apparatus for replenishing toner and collecting used toner, the apparatus comprising:

a replenishment hopper having a supply of fresh toner;

a development device for depositing toner onto a recording member having an electrostatic image to be developed;

a feeding device for feeding fresh toner to the development device;

a driver for driving the feeding device to feed fresh toner to the development device;

a collection container for collecting used toner removed from a recording member; and a controller for tracking a first accumulated driver operating on-time and being programmed to compare the first accumulated operating on-time with a first pre-programmed value for determining when the container is to be emptied or to be replaced and providing a signal to indicate that the container is full or to be emptied or to be replaced.

2. The apparatus according to claim 1 wherein the controller tracks a second accumulated driver operating on-time and is programmed to compare the second accumulated operating on-time with a second pre-programmed value to determine when the supply of fresh toner is empty.

3. The apparatus according to claim 2 wherein the driver is a motor and the motor operating on-time is regulated by pulse-width modulation.

4. The apparatus according to claim 2 wherein the driver is a motor and the feeding device is an auger.

5. The apparatus according to claim 1 wherein the driver is a motor and the motor operating on-time is regulated by pulse-width modulation.

6. The apparatus according to claim 5 wherein the controller is programmed to compare the first accumulated motor operating on-time with a third pre-programmed value that is greater than the first pre-programmed value and if the amount of the first accumulated operating on-time is greater than or equal to the third pre-programmed value, the controller provides a signal to cycle down the apparatus.

7. In an electrostatographic machine, a method for replenishing toner and collecting used toner, the method comprising:

providing a replenishment hopper having a supply of fresh toner;

operating a development device for depositing toner onto a recording member having an electrostatic image to be developed;

driving a feeding device and feeding fresh toner to the development device;

collecting used toner in a collection container; and tracking a first accumulated driver operating on-time and comparing the first accumulated operating on-time with a first pre-programmed value for determining when the container is full or to be emptied or to be replaced and providing a signal to indicate that the container is fill or to be emptied or to be replaced.

8. The method according to claim 7 and comparing a second accumulated operating on-time with a second pre-programmed value to determine when the supply of fresh toner is empty.

9. The method of claim 8 wherein the first and second accumulated operating on-times is accumulated from different events.

10. The method according to claim 9 wherein the feeding device includes a motor and the operating on-time of the motor is regulated by pulse-width modulation.

11. The method according to claim 7 wherein the feeding device includes a motor and the operating on-time of the motor is regulated by pulse-width modulation.

12. The method according to claim 11 and comparing the first accumulated motor operating on-time with a third pre-programmed value that is greater than the first pre-programmed value and if the amount of the first accumulated operating on-time is greater than or equal to the third value, a signal is provided to cycle down the machine.

13. In an electrostatographic machine, a method for replenishing toner and collecting used toner, the method comprising:

providing a replenishment hopper having a supply of fresh toner;

operating a development device for depositing toner onto a recording member having an electrostatic image to be developed;

driving a feeding device and feeding fresh toner to the development device;

collecting used toner in a collection container; and tracking a first accumulated driver operating on-time and comparing the first accumulated operating on-time with a first pre-programmed value for determining when the container is full or to be emptied or to be replaced and providing a signal to cycle down the machine.

14. The method according to claim 13 and comparing a second accumulated operating on-time with a second pre-programmed value to determine when the supply of fresh toner is empty.

15. The method according to claim 14 wherein the first and second accumulated operating on-times is accumulated from different events.

16. The method according to claim 15 wherein the feeding device includes a motor and the operating on-time of the motor is regulated by pulse-width modulation.

17. The method according to claim 13 wherein the feeding device includes a motor and the operating on-time of the motor is regulated by pulse-width modulation.

* * * * *